US006513199B1

(12) United States Patent
Cheng

(10) Patent No.: US 6,513,199 B1
(45) Date of Patent: Feb. 4, 2003

(54) HANDLE OF A TROWEL

(76) Inventor: Chun-Yong Cheng, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 09/984,079

(22) Filed: Oct. 26, 2001

(51) Int. Cl.[7] ..... B05C 17/10

(52) U.S. Cl. ..... 16/436; 16/422; 16/421; 294/57; 15/235.4; 74/543; 30/340

(58) Field of Search ..... 16/436, 110 R, 16/114 R, 110.1, 111.1, 422, 421; 294/57, 49, 7; 30/169, 329, 337, 340, 341–344; 15/235.4, 143.1, 235.8; 74/553, 543, 551.9; 81/177.1, 177.85, 489

(56) References Cited

U.S. PATENT DOCUMENTS 3,853,495 A * 12/1974 Shire
4,224,713 A * 9/1980 Trent
4,817,231 A * 4/1989 Ocwieja ..... 15/143.1
4,841,638 A * 6/1989 Bardeen et al.
4,864,727 A * 9/1989 Chu
5,327,612 A * 7/1994 Kelsay ..... 15/143.1
5,333,348 A * 8/1994 Schumacher et al. ..... 15/145
5,491,896 A * 2/1996 Stolzer et al. ..... 15/236.01
5,918,513 A * 7/1999 Ho ..... 81/177.4
6,223,384 B1 * 5/2001 Kuhlen ..... 15/143.1
6,247,204 B1 * 6/2001 Hamby et al. ..... 16/431

* cited by examiner

*Primary Examiner*—Anthony Knight
*Assistant Examiner*—Mark Williams

(57) ABSTRACT

A handle of a trowel, comprising a penetrating hole disposed longitudinally within, with one end rim thereof extending to form an arcuate bearing piece permitting a narrow rod of a blade to insert in the penetrating hole and to press against onto a concaved arc-plane on the front rim of the bearing piece, is characterized that the circumferential side of the penetrating hole of the handle is disposed longitudinally with a plurality of ribs to enable the inserted narrow rod at the distal end of the blade to have preferred tightness; a disposed sealing cover and the bearing piece have corresponding shapes, both interlock correspondingly by means of a concave and a convex fastening members to sheath and firmly seal the narrow rod of the blade.

3 Claims, 4 Drawing Sheets

HANDLE OF A TROWEL

BACKGROUND OF THE INVENTION

1) Field of the Invention

The present invention provides a handle of a trowel, more specifically, a one with the feature of using multiple fastening methods to tightly seal a narrow rod of a blade so as to prevent a trowel blade from loosening constantly.

2) Description of the Prior Art

Accordingly, when using a trowel to build a wall, a cement worker frequently knocks the bricks by the trowel to make the positions thereof flush, therefore, the trowel itself should has the practical function of resisting vibration and not easily loosening; the most commonly used handle structure of a cement trowel has a narrow rod with a proper diameter disposed at the distal end of the blade and a wooden handle with a hole penetrating in the center; the distal end of the narrow rod of the trowel is forced into the hole of the handle for fastening; however, although the wooden handle possesses a proper tightness, it tends to expand when it gets wet and it tends to contract when it is too dry during the work; after a long usage time, it may crack and decompose to cause the joint area of the handle of the trowel in use to loosen and that is the major shortcoming of this kind of trowel.

Referring to FIG. 5 of a structure of a preferred handle for a trowel, mainly, a penetrating hole (52) is disposed inside the handle (50); an arcuate bearing piece (51) extends from the lower rim of the penetrating hole (52); thereby, when the narrow rod (61) of the trowel blade (60) inserts into the penetrating hole (52) of the handle (50), two sides of the said narrow rod (61) are pressed against by the arcuate bearing piece (51) not to rotate but to make the structure thereof more sturdy; however, when the handle (50) is making a longitudinal knocking vibration, (this is the frequent movement made by the cement worker during building a wall), the blade (60) still doesn't have a proper effect of stopping; therefore, gradually, loosening situation may happen; furthermore, the said bearing piece (51) doesn't tightly and complete joint the narrow rod (61); constantly, the sand and the cement chips may clog in the gap and which will cause the difficulty in cleaning and influence the stability thereof; that is the shortcoming of this kind of structure.

SUMMARY OF THE INVENTION

Therefore, the primary objective of the present invention is to a dispose a penetrating hole longitudinally along a rod body, with one end rim thereof extending to form a bent arcuate bearing piece permitting a narrow rod of a blade to insert in the penetrating hole and to press against onto a concaved arc-plane on the front rim of the bearing piece, wherein, the circumferential side of the penetrating hole of the handle is disposed longitudinally with a plurality of ribs to enable the inserted narrow rod at the distal end of the blade to have preferred tightness; at least one positioning slot and an interlock tenon are disposed on the bearing piece; a sealing cover in a corresponding shape of the bearing piece is disposed to interlock with the bearing piece to sheath the narrow rod so as to firmly seal the blade.

Another objective of the present invention is to dispose a rear press member fixedly sealed from the other end of the penetrating hole of the handle and to make the front end of the said rear press member press against the narrow rod of the blade to position the blade and make it not easy to loosen.

To enable a further understanding of the present invention, a brief description of the drawings below is followed by the detailed description of the preferred embodiment.

DETAILED DESCRIPTION OF THE PREFERRED EMBODIMENTS

Figure 1:
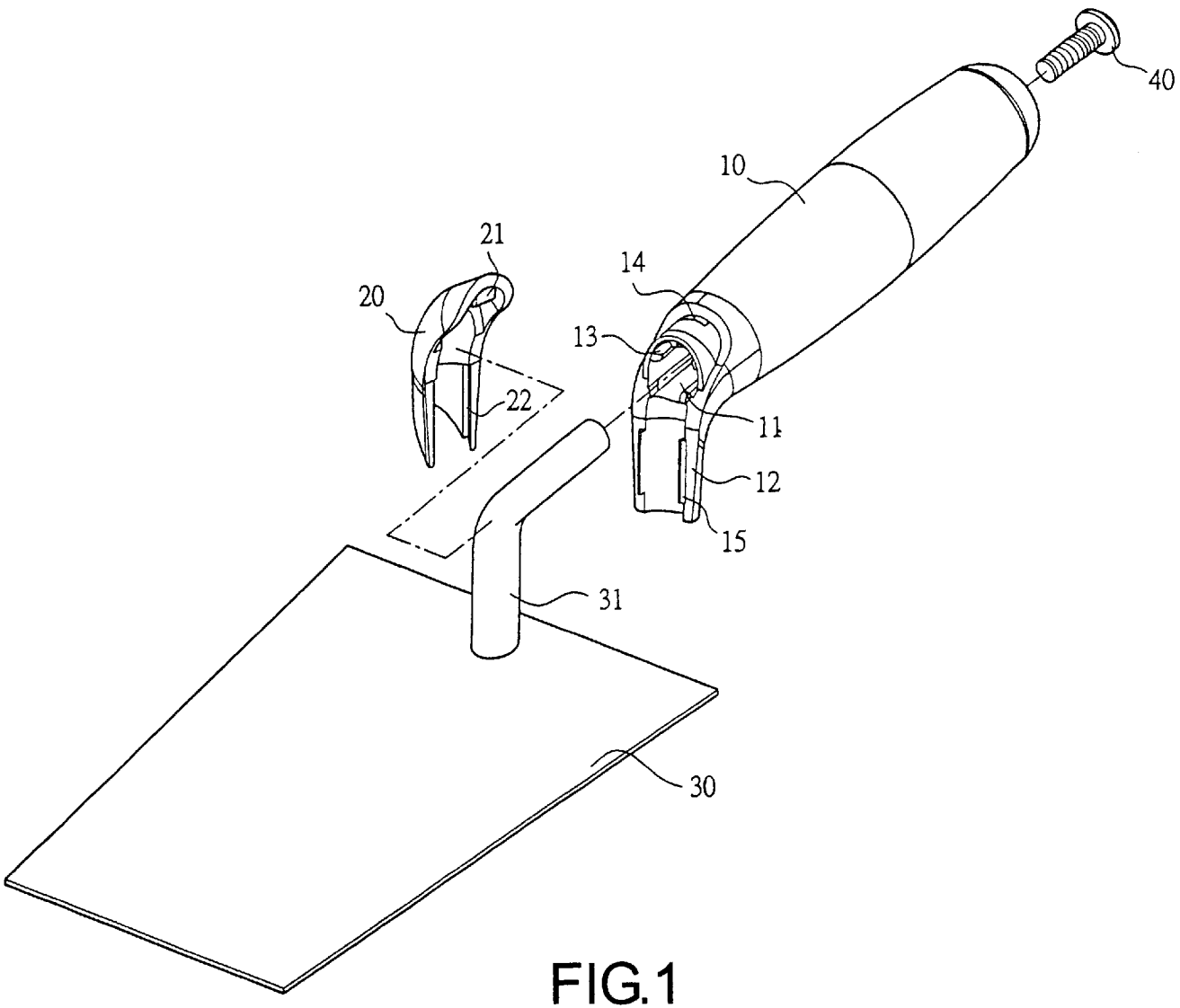
FIG. 1 is an exploded drawing of the structure of the present invention.
Figure 3:
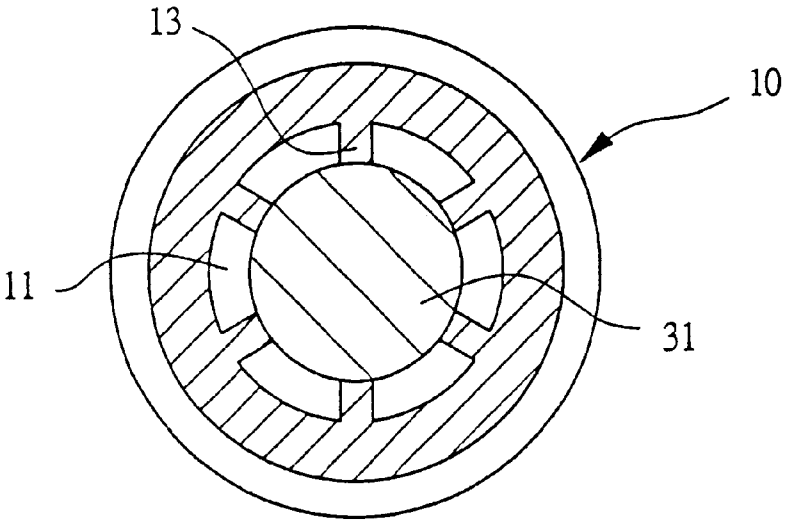
FIG. 3 is a horizontal and cross-sectional drawing of the present invention.
Figure 5:
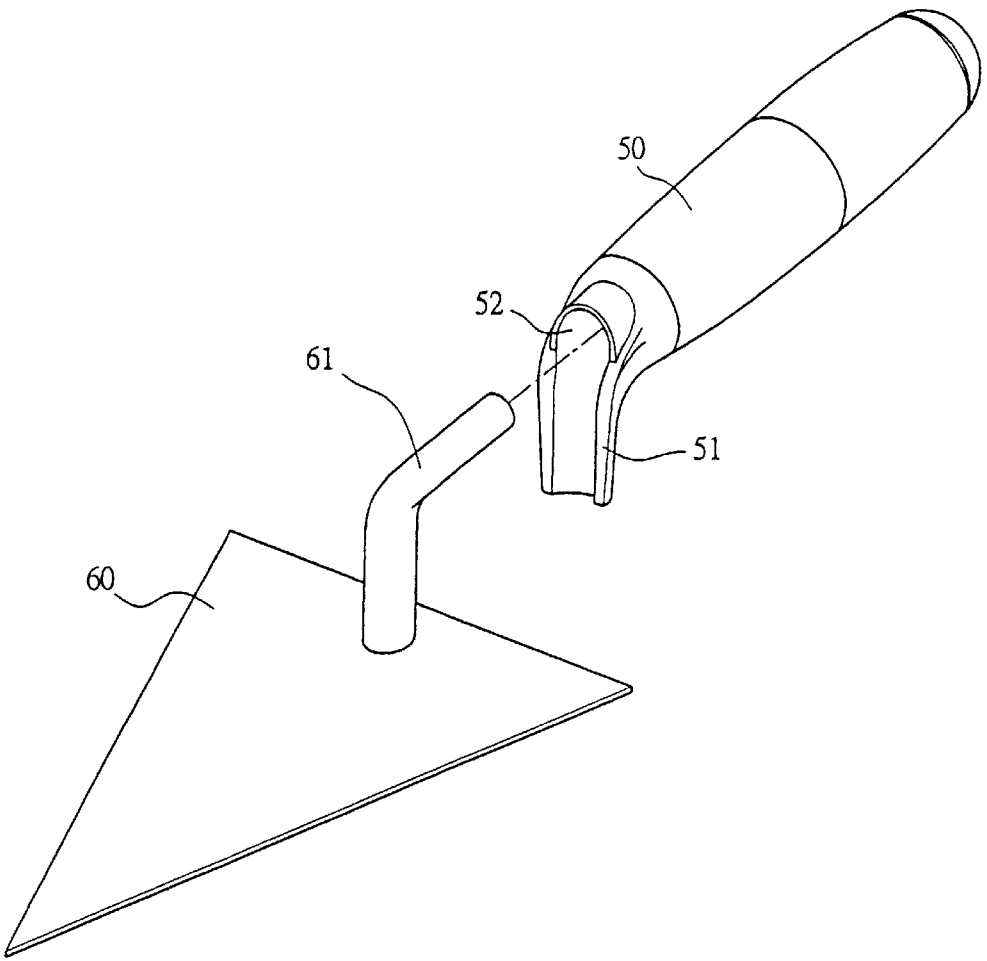
FIG.5 Prior Art
FIG. 5 is an exploded conventional structure.

Referring to FIGS. 1 and 3, the present invention, comprising a long handle (10), a penetrating hole (11) disposed longitudinally along a rod body, one end rim of the penetrating hole (11) extending to form a bent arcuate bearing piece (12) permitting a narrow rod (31) of a blade (30) to insert in the penetrating hole (11) and to press against onto a concaved arc-plane on the front rim of the bearing piece (12), is characterized that the circumferential side of the penetrating hole (11) of the handle (10), as shown in FIG. 3, is disposed longitudinally with a plurality of ribs (13) of a proper resilient body (nylon or P.P. material, etc.) to enable the inserted the narrow rod (31) at the distal end of the blade (30) to have preferred tightness; as shown in FIG. 1, the circumferential side of the bearing piece (12) is formed to have step-shaped concave rib; at least one positioning slot (14) and an interlock tenon (15) are disposed at the proper positions.

Figure 2:
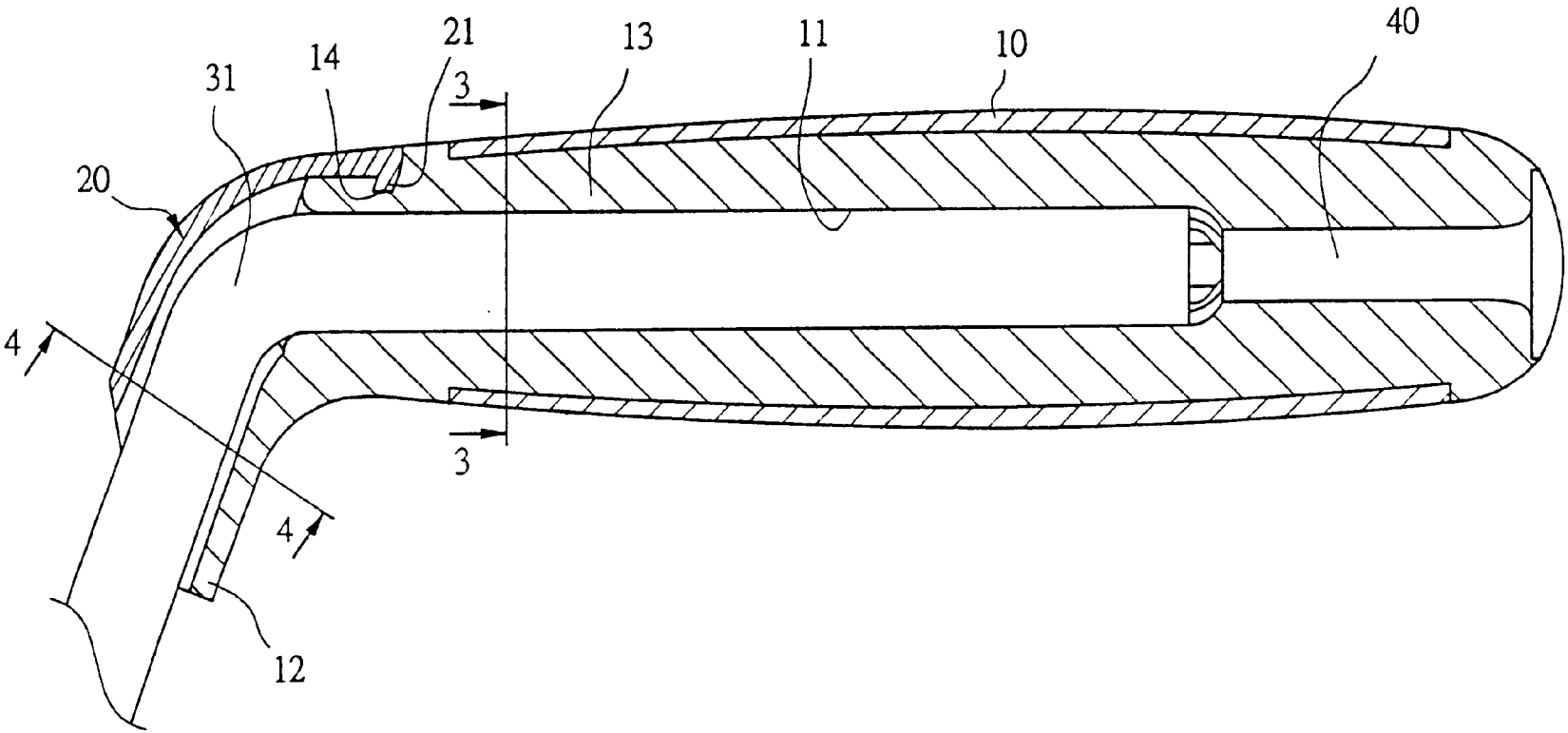
FIG. 2 is a longitudinal and sectional drawing of the present invention.
Figure 4:
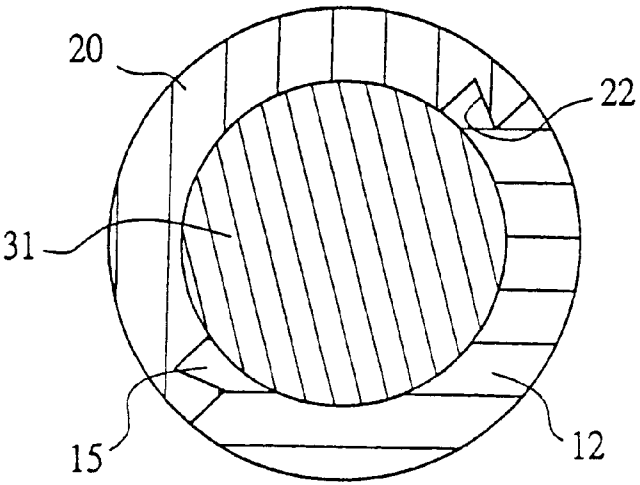
FIG. 4 is another horizontal and cross-sectional drawing of the present invention.

Referring to FIGS. 1 and 3, a sealing cover (20) is in a corresponding shape of the bearing piece (12) with a concave arc formed at the center; a convex block (21) and several interlock slots (22) are disposed relatively; thereby, the circumferential rim of the sealing cover (20) interlocks the step-shaped rib on the circumferential side of the bearing piece (12); at the same time, as shown in FIGS. 2 and 4, the convex block (21) and the interlock slots (22) fitly interlock the ribs (13) and the interlock tenon (15) of the bearing piece (12) to sheath and tightly seal the narrow rod (31).

Referring to FIGS. 1 and 3, the feature of the present invention is to have a rear press member (40) in certain length, such as a screw or a rivet, sealed from the other end of the penetrating hole (11) of the handle (10) to position the blade (30), pressing against the rear press member (40) by the narrow rod (31) and vibrating by being knocked, to prevent loosening so as to have the effect of more tight connection.

The special innovation of the present invention has the following advantages in application:

1. The primary advantage of the present invention is to dispose a penetrating hole with ribs inside the handle to make the narrow rod forced to insert therein more tightly interlock and uneasy to rotate and loosen.
2. Another advantage of the present invention is to dispose a sealing cover to interlock a bearing piece correspondingly and together to tightly sheath the narrow rod.
3. The present invention disposes a rear press member at the distal end of the handle, such as a screw or a rivet;

the front end thereof fitly press against the narrow rod of the blade to fasten the blade, pressing against the rear press member by the narrow rod and vibrating by being knocked, to prevent loosening so as to have the effect of more tight connection.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A handle of a trowel, comprising a penetrating hole disposed longitudinally along a rod body, with one end rim thereof extending to form a bent arcuate bearing piece permitting a narrow rod of a blade to insert in the penetrating hole and to press against onto a concaved arc-plane on the front rim of the bearing piece, is characterized that:

a plurality of ribs are disposed longitudinally on the circumferential side of the penetrating hole of the handle to enable the inserted narrow rod at the distal end of the blade to have preferred tightness; at least one position slot and an interlock tenon are disposed on the bearing piece;

a sealing cover has the corresponding shape of the bearing piece and has a convex block as well as a interlock slot disposed correspondingly, thereby the sealing cover interlocks the bearing piece to sheath the narrow rod in a firm seal.

2. A handle of a trowel according to claim 1, wherein, a rear press member is disposed and fixedly sealed from the other end of the penetrating hole of the handle to make the front end of the said rear press member fitly press against the narrow rod of the blade for positioning.

3. A handle of a trowel according to claim 1, wherein, a rib inside the penetrating hole of the handle is made of resilient nylon or P.P. material.

* * * * *